US006101941A

United States Patent [19]

Aubert et al.

[11] Patent Number: 6,101,941

[45] Date of Patent: Aug. 15, 2000

[54] PRINTING UNIT CYLINDER OF A ROTARY PRINTING PRESS AND BENT PRINTING FORM FASTENABLE ON A PRINTING FORM CYLINDER OF A ROTARY PRINTING PRESS

[75] Inventors: Philippe Aubert, Precy sur Oise; Alain Blanchard, Gouvieux; Herve Dumor, Nogent sur Oise; Robert Gaultier, Verneuil en Halatte; Patrick Lepeltier, Angicourt; Jany Michaux, St. Lev d'Esserent; Francois Recolet, Breuil-le-Vert, all of France

[73] Assignee: Heidelberger Druckmaschinen Aktiengesellschaft, Heidelberg, Germany

[21] Appl. No.: 09/277,788

[22] Filed: Mar. 29, 1999

[30] Foreign Application Priority Data

Mar. 27, 1998 [FR] France ..... 98 03816

[51] Int. Cl.[7] ..... B41F 1/28

[52] U.S. Cl. ..... 101/415.1; 101/378

[58] Field of Search ..... 101/415.1, 378

[56] References Cited

U.S. PATENT DOCUMENTS

| | | | |
|---|---|---|---|
| 695,414 | 3/1902 | North | 101/415.1 |
| 2,109,152 | 2/1938 | Meisel | 101/415.1 |
| 2,157,621 | 5/1939 | Neilson | 101/415.1 |
| 5,090,319 | 2/1992 | Weber et al. | 101/483 |
| 5,178,068 | 1/1993 | Junghans et al. | 101/415.1 |
| 5,323,702 | 6/1994 | Vrotacoe et al. | 101/217 |
| 5,398,608 | 3/1995 | Kobayashi | 101/415.1 |
| 5,429,048 | 7/1995 | Gaffney et al. | 101/217 |
| 5,440,981 | 8/1995 | Vrotacoe et al. | 101/217 |
| 5,551,340 | 9/1996 | Bolza-Schünemann et al. | 101/415.1 |

FOREIGN PATENT DOCUMENTS

| | | |
|---|---|---|
| 0 193 144 A2 | 9/1986 | European Pat. Off. . |
| 0 699 531 | 3/1996 | European Pat. Off. . |

OTHER PUBLICATIONS

Japanese Patent Abstract No. 06255085 (Takao), dated Sep. 13, 1994.

*Primary Examiner*—John S. Hilten
*Assistant Examiner*—Leslie J. Grohusky
*Attorney, Agent, or Firm*—Herbert L. Lerner; Laurence A. Greenberg; Werner H. Stemer

[57] ABSTRACT

In a rotary printing press, a printing unit cylinder having a printing form with bent ends fastened thereon so as to form a printing form cylinder with a printing form mounted thereon, the bent ends of the printing form being provided with fastening tabs extendable into the interior of lock-up gap sections formed in the printing form cylinder, and webs respectively alternatingly disposed opposite one another being formed on a leading edge and on a trailing edge of the printing form, between the fastening tabs of the printing form, includes a plurality of pockets formed on a circumferential surface of the printing form cylinder, wherein the fastening tabs of the printing form engage, the webs provided between the fastening tabs and formed on the printing-form leading edge and the printing-form trailing edge terminating on generating lines of the printing form cylinder which differ from one another.

11 Claims, 6 Drawing Sheets

3
11
1
10
5
9
10
9
10
9
10
9
6
2
10
7
8
12
4
36
37

PRINTING UNIT CYLINDER OF A ROTARY PRINTING PRESS AND BENT PRINTING FORM FASTENABLE ON A PRINTING FORM CYLINDER OF A ROTARY PRINTING PRESS

BACKGROUND OF THE INVENTION

Field of the Invention

The invention relates to a printing unit cylinder of a rotary printing press and to a bent printing form fastenable on a printing form cylinder of a rotary printing press.

Exemplary of the prior art, the published European Patent Document EP 0 445 645 A1 discloses a printing unit cylinder that is provided with an axially parallel, narrow cylinder gap for receiving therein rubber blanket or printing plate ends. A filling piece for bridging the gap orifice is provided so that when two mutually cooperating cylinders roll over such cylinder gaps, the cylinders are prevented from vibrating. The filling piece is supported on or braced against the rubber blanket or the printing plate on both sides of the gap orifice. It is formed of elastic material and has an outer contour by which it projects beyond the cylinder diameter. The filling piece, furthermore, has a resilient extension that extends radially inwardly into the gap, the filling piece remaining in bearing contact with the rubber blanket or the printing plate via the spring force of the resilient extension.

The published European Patent Document EP 0,430,006 A2 discloses a printing unit cylinder for rotary printing presses. A gap web is arranged at the bottom of the cylinder gap and is releasably fastened in the cylinder gap by a fastening device. The gap web is of such height that the gap webs of two cooperating cylinders meet one another. The gap web is formed as a plate and is subdivided into individual zones by slots extending in the longitudinal direction thereof. Longitudinal slots are assigned to the zones and, when two gap webs meet one another, make it possible for the outer contour of the gap web to spring back elastically.

The published European Patent Document EP 0,697,286 A1 relates to a flexible plate with bent ends for fastening the plate on a cylinder of a rotary printing press. The bent ends are provided, respectively, with fastening tabs arranged in a comblike manner, clearances being provided alternately between the fastening tabs. Starting at one end of the plate from a flexural line of the fastening tabs, the latter extend into the plate. At a second end of the plate, between the fastening tabs, tongues are provided which continue beyond the flexural line of the fastening tabs, the tongues and indentations being adjusted or matched to one another so that, in the fastened state, the tongues and indentations are arranged so as to intermesh like teeth. The tongues are at least of such length that they at least cover the axial opening of the breadth of an outer surface of the cylinder. An aperture angle of the fastening tabs at the print end and an aperture angle of the fastening tabs at the start of printing are formed as supplementary angles.

The published European Patent Document EP 0,699,531 A1 relates to a device for fastening flexible plates with bent ends on a cylinder of a rotary printing press.

In this configuration, fastening tabs arranged in a comblike manner are provided at the bent ends of the printing plates, and the otherwise closed outer surface of the cylinder is provided with a plurality of narrow pockets which are disposed in the axial direction, extending from the outer surface into the interior of the cylinder. The breadth or width of the pockets is greater than the thickness of the printing plates.

The technical problem upon which the solution proposed hereinbelow is based is how to avoid, as much as possible, the excitations of vibrations for printing unit cylinders in printing units of rotary printing presses, in order to achieve higher printing speeds in conjunction with better printing results. Vibrations may lead to a considerable reduction in the press proofing forces prevailing between the mutually cooperating printing unit cylinders, so that the conditions for ink transfer deteriorate quickly, and streaking occurs in the print.

In order to reduce the excitations of vibrations in the printing unit, the method of attaching gap-free rubber blanket sleeves to the rubber blanket cylinder was adopted, such blanket sleeves having become known heretofore from the published European Patent Documents EP 0421 145 A2 and EP 0 514 344 B1. Thus, the disappearance of the gap on the rubber blanket cylinder eliminated the excitation of vibrations by the latter. When planar finite printing plates are used, it is necessary to provide lock-up devices on the plate cylinders in order to fasten the finite printing plates on the circumferential surface thereof. In order to minimize the excitation of vibrations by the lock-up gaps remaining on the printing plate cylinders, the gaps for receiving the lock-up devices were reduced repeatedly further, and the transitions between the mutually opposite ends of the printing form fastened on the circumference of the printing unit cylinder were improved.

SUMMARY OF THE INVENTION

In view of the foregoing prior art and the technical background, it is an object of the invention to provide a printing unit cylinder and a bent printing form on a printing unit cylinder of a rotary printing press which, on the one hand, serve to maintain lock-up devices for making possible the use of automatic printing plate feeding systems for changing the printing plates on the printing unit cylinder and, on the other hand, serve further to improve transitions between the leading and trailing edges of the plate, the transitions occurring in the case of finite printing plates.

With the foregoing and other objects in view, there is provided, in accordance with one aspect of the invention, in a rotary printing press, a printing unit cylinder having a printing form with bent ends fastened thereon so as to form a printing form cylinder with a printing form mounted thereon, the bent ends of the printing form being provided with fastening tabs extendable into the interior of lock-up gap sections formed in the printing form cylinder, and webs respectively alternatingly disposed opposite one another being formed on a leading edge and on a trailing edge of the printing form, between the fastening tabs of the printing form, comprising a plurality of pockets formed on a circumferential surface of the printing form cylinder, the plurality of pockets engage the fastening tabs of the printing form, the webs provided between the fastening tabs and formed on the printing-form leading edge and the printing-form trailing edge terminating on generating lines of the printing form cylinder which differ from one another.

In accordance with another feature of the invention, the printing unit cylinder having a printing form mounted thereon is in cooperative engagement with a further printing unit cylinder having a continuous rubber blanket sleeve mounted on the circumference thereof.

In accordance with another feature of the invention, abutment locations of the webs are arranged alternatingly over the breadth of the printing unit cylinder.

In accordance with a further feature of the invention, the abutment locations of the webs lie alternatingly on a first generating line and a second generating line of the printing unit cylinder.

In accordance with an added feature of the invention, the abutment locations are formed between the webs and indentations corresponding respectively thereto on the printing-form leading and the printing-form trailing edges, respectively.

In accordance with an additional feature of the invention, the abutment locations are formed above material bridges of the printing unit cylinder.

In accordance with yet another feature of the invention, the abutment locations are at a spaced distance of between 0.1 and 0.2 mm from one another.

In accordance with yet a further feature of the invention, the distance is preferably 0.1 mm.

In accordance with yet an added feature of the invention, the printing form is locked-up on the circumferential surface of the printing form cylinder by lock-up elements at the trailing edge of the printing form, the webs and the indentations corresponding thereto being pushed within one another.

In accordance with yet an additional feature of the invention, the run is at an inclination into the interior of the printing unit cylinder.

In accordance with still another feature of the invention, the fastening tabs on the printing-form leading edge engage with a side of the pocket that is located opposite the lock-up elements.

In accordance with a further aspect of the invention, a printing unit cylinder is provided in combination with a pair of cylinders including a printing plate cylinder and a transfer cylinder, on the circumference of which an exchangeable gap-free rubber blanket sleeve is mounted, comprising supporting regions formed on the printing unit cylinder for supporting supporting surfaces of a printing form.

In accordance with an added feature of the invention, the supporting surfaces of the printing form engage in corresponding indentations formed in the respectively opposite printing-form edge.

In accordance with a concomitant feature of the invention, the abutment locations formed between the supporting surfaces and the corresponding indentations terminate on generating lines differing from one another on the circumferential surface of the printing form cylinder.

The advantage offered by the invention is that the regions, in which the leading and trailing edges of the printing plate butt against one another on the circumference of the plate cylinder, no longer lie on an imaginary generating line of the printing unit cylinder but, instead, the point of discontinuity, that is to say the vibration-exciting point of disturbance, compelled by the abutment locations, is allocated to a larger region on the circumferential surface of the cylinder. The vibration-exciting disturbance is accordingly decisively reduced. Consequently, in turn, the pressing between the mutually cooperating cylinder surfaces can be maintained, so that higher speeds and a constantly high printing quality can be achieved.

In a particularly advantageous embodiment of the invention, the impression cylinder according to the invention, that is provided with a printing form according to the invention, cooperates with a gap-free rubber blanket cylinder, on the circumference of which a continuous rubber blanket sleeve is mounted. A point or location of discontinuity in the form of a gap is, by definition, absent in the sleeve. In the printing form according to the invention, supporting surfaces in the form of webs are arranged between the pockets for fastening the printing form, the webs terminating alternatingly on generating lines or generatrices of the circumferential surface of the printing unit cylinder which are different from one another. The webs can cooperate with corresponding indentations on the leading and trailing edges of the printing form and are located above the material bridges between the pockets for receiving the fastening tabs of the printing form therein. The abutment locations are at a spaced distance of between 0.1 and 0.2 mm from one another, the vibration excitation or stimulus being all the more favorable, the smaller that the spacing at the abutment location can be maintained.

Advantageously, when the printing form is being tautened or locked up, the supporting surfaces, i.e., the webs and the corresponding indentations, are pushed into one another, with the result that the fastening of the printing form in the pockets and the formation of a substantially closed surface of the printing form can be achieved simultaneously. The pockets run at an inclination into the interior of the printing unit cylinder, a lateral surface of the pocket forming a bearing surface for a fastening tab of the printing-form leading edge. When the printing-form leading edge is resiliently thrown onto the surface of the printing unit cylinder by an automatic plate changer, the leading edge automatically snaps into the pocket wherein the printing form trailing edge can also be clamped after the rotation of the cylinder has taken place.

In a printing unit with an aforedescribed printing form, together with a printing unit cylinder and a gap-free rubber blanket cylinder having an exchangeable sleeve, the printing unit cylinder has supporting regions formed thereon, on which the aforedescribed supporting surfaces, the webs, are supported on the circumference of the printing unit cylinder. Other features which are considered as characteristic for the invention are set forth in the appended claims.

Although the invention is illustrated and described herein as embodied in a printing unit cylinder and a bent printing form fastenable on a printing unit cylinder of a rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
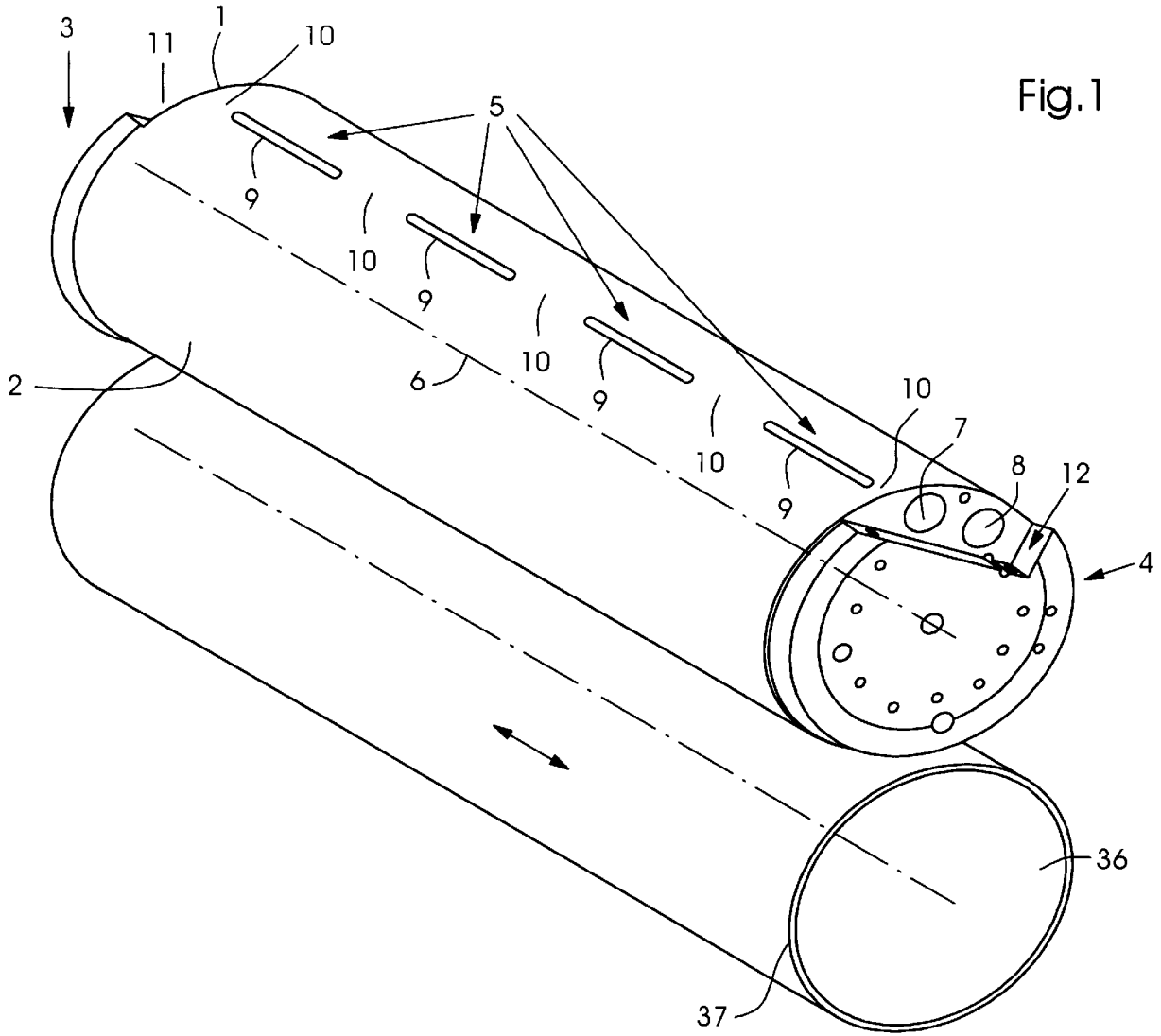
FIG. 1 is a perspective end, side and top view of a printing plate cylinder with pockets arranged on the circumference and located next to one another.

Referring now to the drawings and, first, particularly to FIG. 1 thereof, there is shown therein a printing unit cylinder in the form of a plate cylinder 1 according to the invention. A circumferential surface 2 thereof, around which a printing plate is wound, is located between a lefthand end face 3 and a righthand end face 4 of the printing unit cylinder 1, as viewed in the figure. Individual pockets 9 are formed in lock-up regions 5, which are separated from one another by material bridges 10 and into which fastening tabs of a printing form or plate engage. Cavities 7 and 8 for lock-up devices of the printing form can be seen on the righthand end face 4, the cavities 7 and 8 extending parallel to the axis of rotation 6 of the printing unit cylinder 1. Recesses 11, 12 are provided in each case on the two end faces 3, 4 in order to receive actuating elements for the tensioning devices. The printing unit cylinder 1 co-operates with a transfer cylinder 36, on the circumference of which a gap-free rubber blanket sleeve 37 is attached. The latter may be slid onto the cylinder 36 or withdrawn therefrom laterally in the direction of the double-headed arrow.

Figure 2:
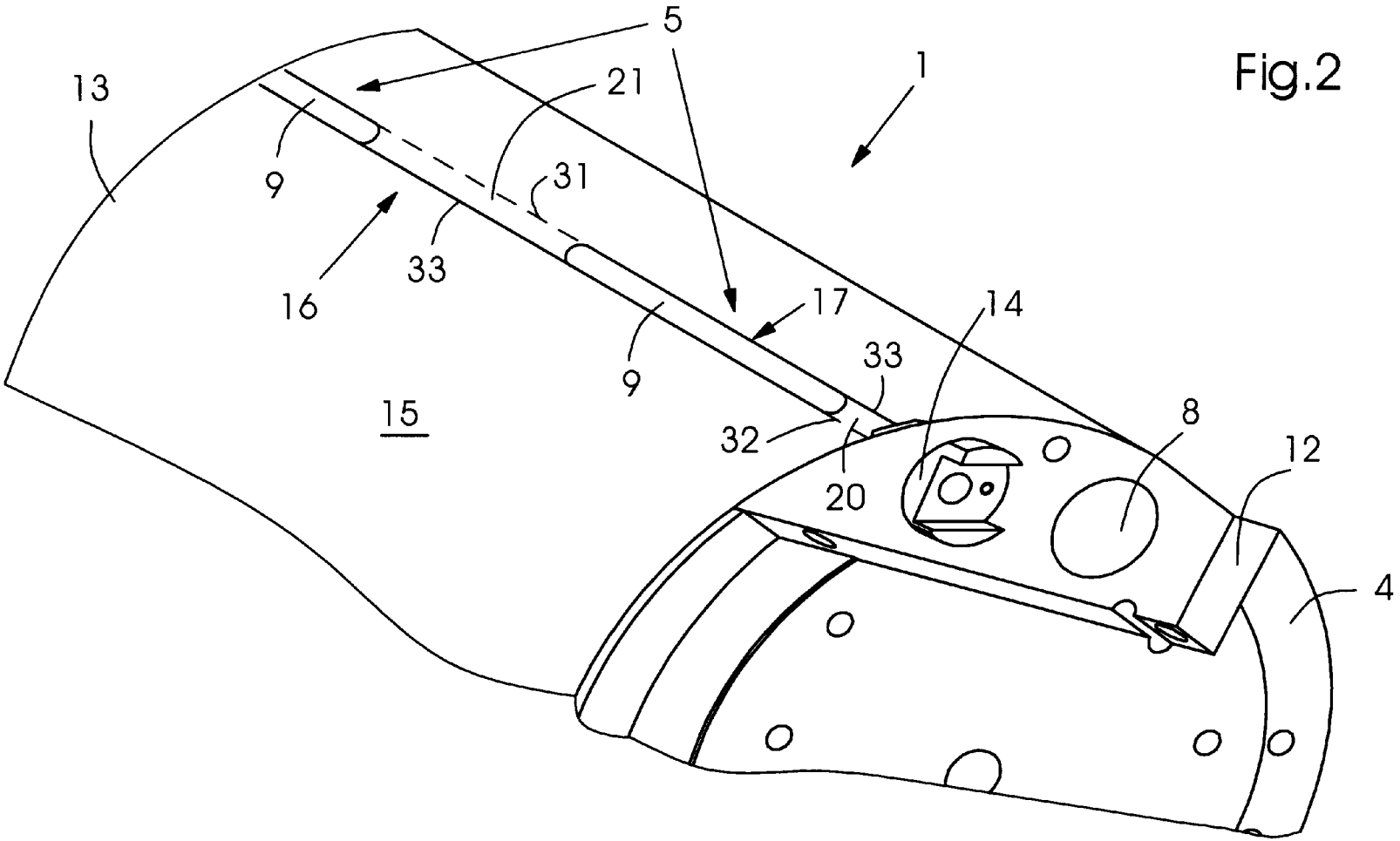
FIG. 2 is an enlarged fragmentary view of FIG. 1.

FIG. 2 is an enlarged fragmentary view of FIG. 1, showing diagrammatically an exemplary embodiment of the printing unit cylinder 1 in which there is indicated an edge or marginal web 20 and a web 21 located adjacent to one another in the lock-up region 5, without showing in detail how the printing form 13 is fastened in the pockets 9.

Located on the printing unit cylinder 1 is a printing form 13 having a surface 15 wound around the cylinder 1. The printing-form leading edge 16 and the printing-form trailing edge 17, respectively, are located opposite one another in the lock-up region 5, as shown also in FIG. 5. It is believed to be readily apparent from FIG. 2 that an abutment location 33 between the marginal web 20 and the printing-form trailing edge 17 lies on a generating line 31, whereas another abutment location 33 disposed between the web 21 and the printing-form leading edge 16 and located farther towards the center of the printing unit cylinder 1, lies on a different generating line 32. Fastening tabs of the printing plate 13 engage in the individual pockets 9, as particularly illustrated in greater detail in the following FIGS. 3 and 5.

Embedded in the cavity 7 for lock-up devices is a lock-up spindle 14 that extends parallel to the rotational axis 6 of the printing form cylinder 1 and by which the printing plate 13 is fastened on the circumference of the printing unit cylinder 1. The clawlike extension on the lock-up spindle 14 serves for applying an actuating member thereto.

Figure 3:
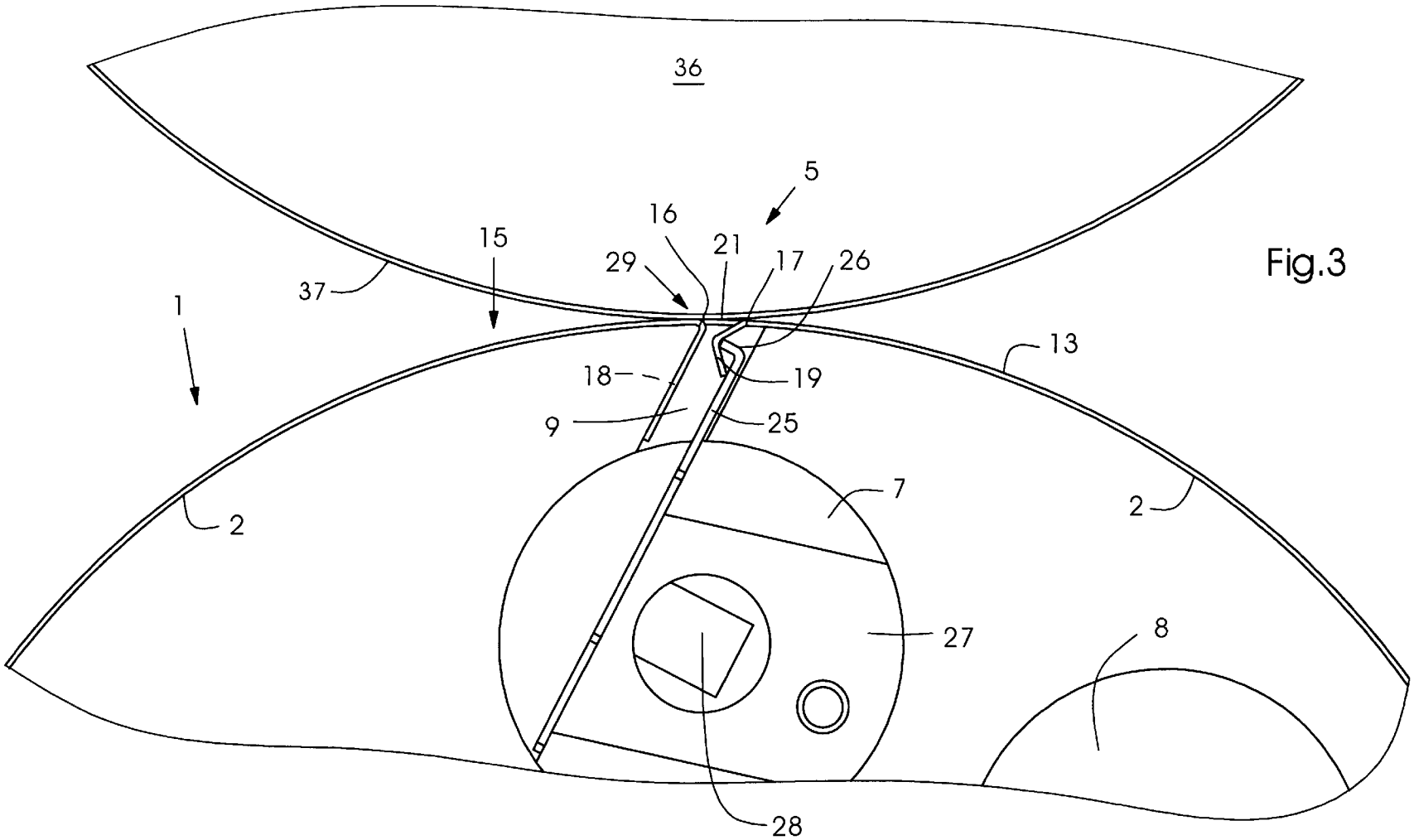
FIG. 3 is a fragmentary cross-sectional view of hereinafter-described FIG. 5, taken along the line III—III therein and showing mutually engaging printing plate and blanket cylinders, a region of the printing plate cylinder being illustrated wherein a pocket is located for receiving fastening tabs of a printing plate therein.

FIG. 3 is a cross-sectional view of the printing plate cylinder 1 taken along the line III—III in the region of a pocket for receiving the fastening tabs of the printing form 13 therein.

The printing form 13 is in areal bearing contact on the printing unit cylinder 1, the printing form surface 15 lying flush on the circumferential surface 2 of the printing unit cylinder 1. A lock-up spindle is provided in the cavity 7 for the lock-up devices, and includes a lock-up member 27 having a tool extension 28, lock-up springs 25 being mounted on the lock-up member 27 in the region of the pockets 9. The lock-up springs 25 are located on the lock-up member 27 solely in the region of the pockets 9, the springs 25 being absent in the region of the material bridges 10 between the individual pockets 9 on the circumferential surface 2 of the printing unit cylinder 1. The lock-up springs 25 may be screwed to the lock-up member 27 or may be connected to the latter in another manner, so that a rotational movement of the lock-up member 27 automatically entails a pretensioning of the lock-up springs 25. Provided on the lock-up springs 25 is a hook-shaped end 26 that engages under a fastening tab 19 on the trailing edge 17 of the printing form 13.

The corresponding fastening tab 18 of the leading edge 16 of the printing form 13 is inserted over an inclined side of the pocket 9. Tensioning or tautening of the printing form 13 on the circumferential surface 2 of the printing unit cylinder 1 consequently takes place at the trailing edge 17 of the printing form 13.

Along the flexural or bending line 35 thereof, the fastening tabs 19 bend into the interior of the pocket 9 whereas, as illustrated here in a side view, a web 21 extends over the circumferential surface 2 of the printing unit cylinder 1 in the region of the material bridges 10 (note FIG. 2) and generates an approximately closed surface 29 in the tensioning region 5 between the pockets 9. Consequently, in the region of the pockets 9 extending at an inclination into the interior of the printing unit cylinder 1, there is an interruption in the closed outer surface 29 of the printing form 13 whereas, according to the alternating arrangement of the pockets 9 and the material bridges 10 along the width of the printing unit cylinder 1, the printing form has, in the region of the material bridges 10, only a surface 29 that is virtually closed due to a minimal abutment location 33.

Figure 4:
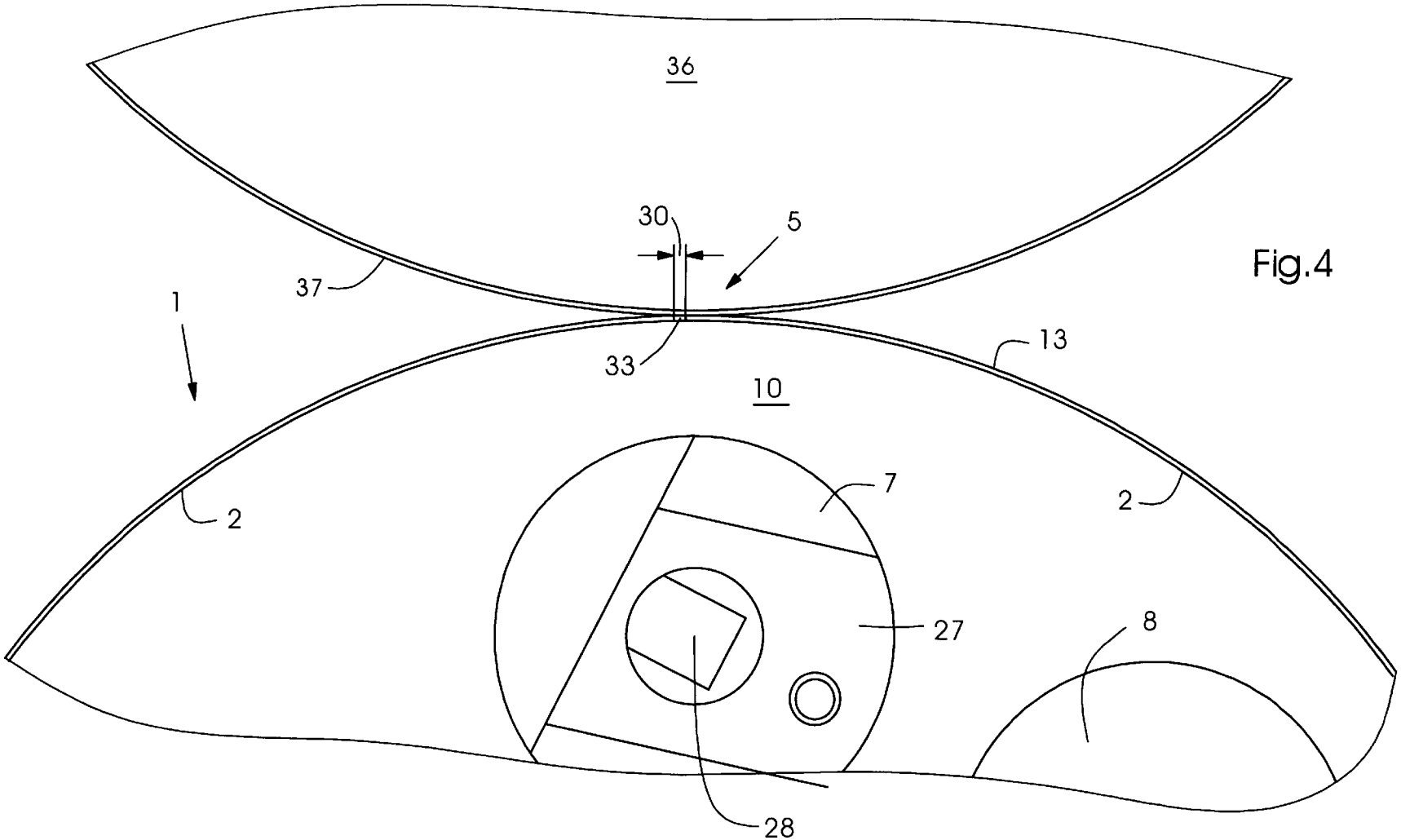
FIG. 4 is another fragmentary cross-sectional view of FIG. 5, taken along the line IV—IV therein and showing a region of the printing plate cylinder wherein a material bridge is located between two pockets.
Figure 5:
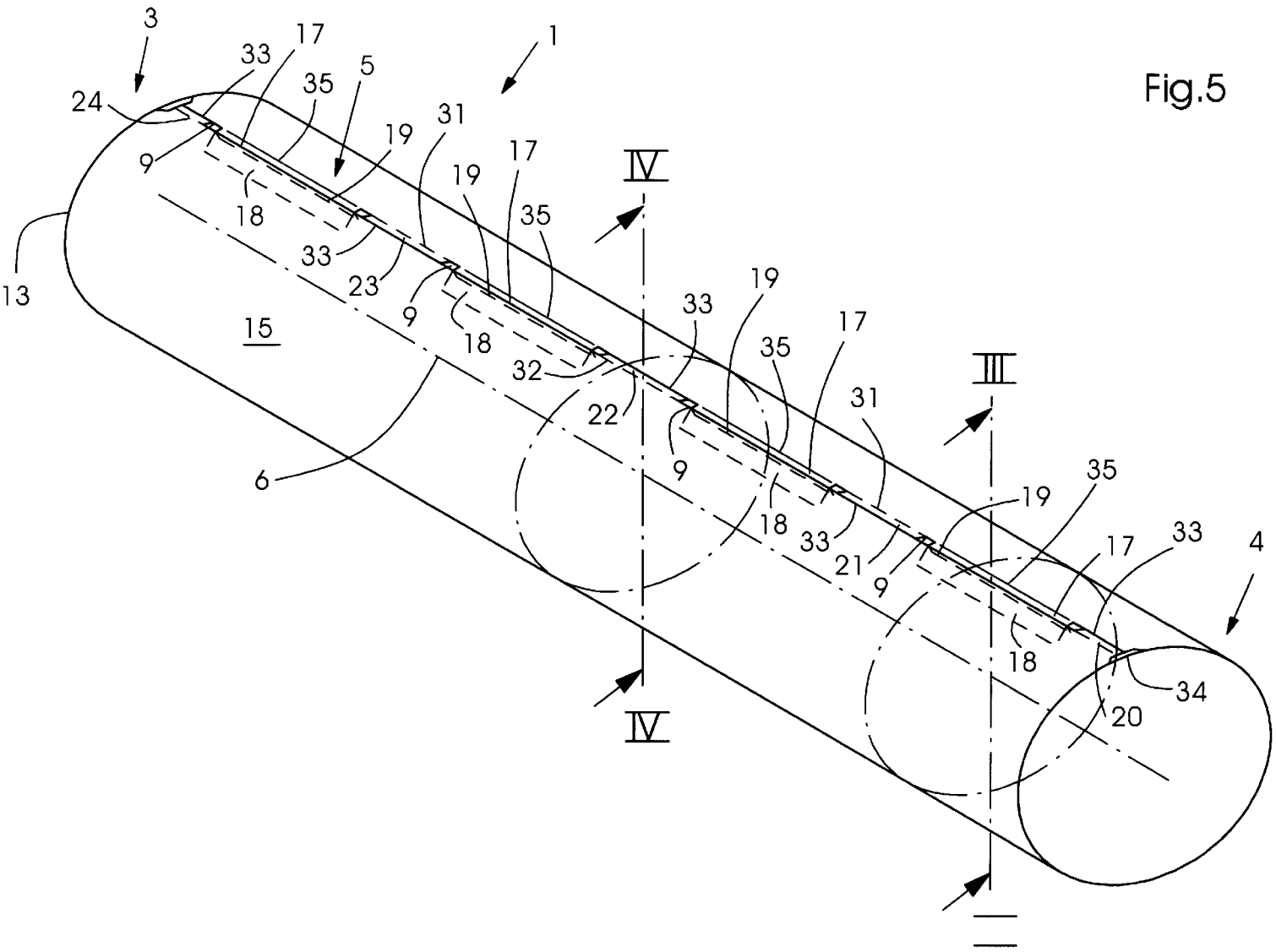
FIG. 5 is a perspective end, side and top view of a printing plate cylinder with mutually bordering tongues and indentations of a printing form having bent ends, the tongues and indentations being in a lock-up region.

FIG. 4 is a cross-sectional view, taken along the line IV—IV in FIG. 5, of the printing unit cylinder in the region of a material bridge 10 between two pockets 9.

The printing form 13 lies on the circumferential surface 2 of the printing unit cylinder 1. The cross-sectional view of the printing unit cylinder 1 of FIG. 4 is located between two pockets 9, between which a material bridge 10 is formed. The two cavities 7 and 8, respectively, for the lock-up devices are located below the material bridge 10. In a manner corresponding to that of the cross-sectional view presented in FIG. 3, the lock-up member 27 of the lock-up spindle 14 extends through the entire bore along the axial length thereof and is likewise shown in the cavity 7.

An abutment location 33 is reproduced on a greatly enlarged scale in FIG. 4. The distance 30 which, in the interest of clarity has been illustrated greatly enlarged, is between 0.1 and 0.2 mm. In the cross-sectional view reproduced in FIG. 4, the abutment location 33, that is shown enlarged, lies on a cylinder generating line or generatrix 31 (note FIG. 5 hereinafter). In a cross-sectional view of the printing unit cylinder 1 in the region of another material bridge 10 between two pockets 9, the abutment location 33 (note FIG. 5 hereinafter) lies on a different generatix 32. Provided above the printing unit cylinder 1 is a gap-free rubber blanket cylinder 36, on the circumferential surface of which a gap-free sleeve 37 is attached. This arrangement is provided in a printing unit that prints the underside of a material web.

FIG. 5 is a perspective view of a printing plate cylinder 1 with tongues and indentations or notches of a printing form having bent ends, the tongues and indentations being adjacent one another in the lock-up region 5.

The printing form 13 is fastened, respectively, at the bent leading edge 16 thereof and at the bent trailing edge 17 thereof, onto the printing unit cylinder 1 that has, respectively, righthand and a lefthand end faces 3 and 4 which are otherwise not illustrated in any greater detail. The printing unit cylinder 1 rotates about the rotational axis 6 thereof, the drive and the mounting support, respectively, thereof having been dispensed with. Pockets 9, respectively, which are embedded between material bridges 10, lie along the axial length of the printing unit cylinder 1 in the lock-up region 5. The pockets 9 receive both the fastening tabs 18 provided on the printing-form leading edge 16 (note FIG. 3), and the fastening tabs 19 arranged opposite thereto on the printing-form trailing edge 17. The fastening tabs 18 of the printing-form leading edge 16 are introduced into the respective pockets 9 and are represented in broken lines. The fastening tabs 19 of the printing-form trailing edge 17, which are located, respectively, opposite the fastening tabs 18, bend at the flexural edge 35 and, therefrom, likewise extend into the interior of the pockets 9 which run at an inclination into the printing form cylinder 1. In the exemplary embodiment shown, four pockets 9, which are spaced from one another and between which material bridges 10, respectively, extend (note FIG. 1), are located on the circumferential surface 2 of the printing unit cylinder 1. Two cylinder generating lines or generatrices 31 and 32, illustrated by broken lines, are shown on the circumferential surface 2 of the printing unit cylinder 1. They extend, parallel to one another, over the entire axial breadth of the circumferential surface 2 of the printing unit cylinder 1 in the lock-up region 5. In the lock-up region 5, within the area delimited by the generating lines 31 and 32, a transitional region is formed above the material bridge 10 illustrated in FIG. 1 and, within the transitional region, the webs 20 to 24 mutually engage with corresponding indentations formed in the respective opposite printing-form end, and form alternating abutment locations 33. The abutment locations 33 on the righthand end face, for example those of edge web 20 of the printing form leading edge 16 with a corresponding indentation of the printing form trailing edge 17, lie on the generating line 31. The next abutment locations 33 lies between the pockets 9 located on the right of the middle of the circumferential surface 2, the next abutment locations 33 lies on the generating line 32, etc. As seen over the width of the tensioning region 5, therefore, an alternating pattern of abutment points 33 is obtained. Within the abutment point pattern to be achieved by means of this configuration, two abutment points 33, located next to one another, of the printing form leading and trailing edges 16, 17 never lie on a common generating line 31 or 32. The result of this is that the stimulation of vibrations of the pair of cylinders in rolling contact, namely the printing unit cylinder 1 with the transfer cylinder 36 (see FIG. 4), can be reduced appreciably. No vibration stimulation emanates per se from a transfer cylinder 36 provided with an exchangeable rubber blanket sleeve 37. The stimulation of vibrations of a printing unit cylinder according to the invention, equipped with a printing form 13 according to the invention, is reduced in that in the region of the webs 20 to 24, on the one hand, the rolling contact and therefore the mutual pressing of the two rotating surfaces—printing plate with rubber blanket sleeve 37—are maintained and, on the other hand, the abutment points 33 are distributed as microgaps over two generating lines 31, 32. An axially extending source of stimulation of vibrations in the pair of cylinders 1, 36 is thereby distributed over two microgaps, specifically the generating lines 31 and 32, so that the disturbance per se is reduced considerably.

Moreover, in the design according to the invention of the printing unit cylinder 12 and printing form 13, the printing form 13 can continue to be fed to the printing unit cylinder 1 by an automatic plate changing device. For example, the printing form leading edge 16 provided with the fastening tabs 18 can be thrown resiliently onto the circumferential surface of the cylinder 2 and, when it passes the pockets 9 running at an inclination into the cylinder interior, snaps into these. When the printing unit cylinder 1 is slowly rotated further, said cylinder draws the entire surface of the printing form 13 onto its circumference, until the fastening tabs 19 snap into the pocket 9 and the tensioning of the printing form 13 on the circumferential surface 2 of the printing unit cylinder 1 can be carried out by means of the tensioning spring 15.

Figure 6:
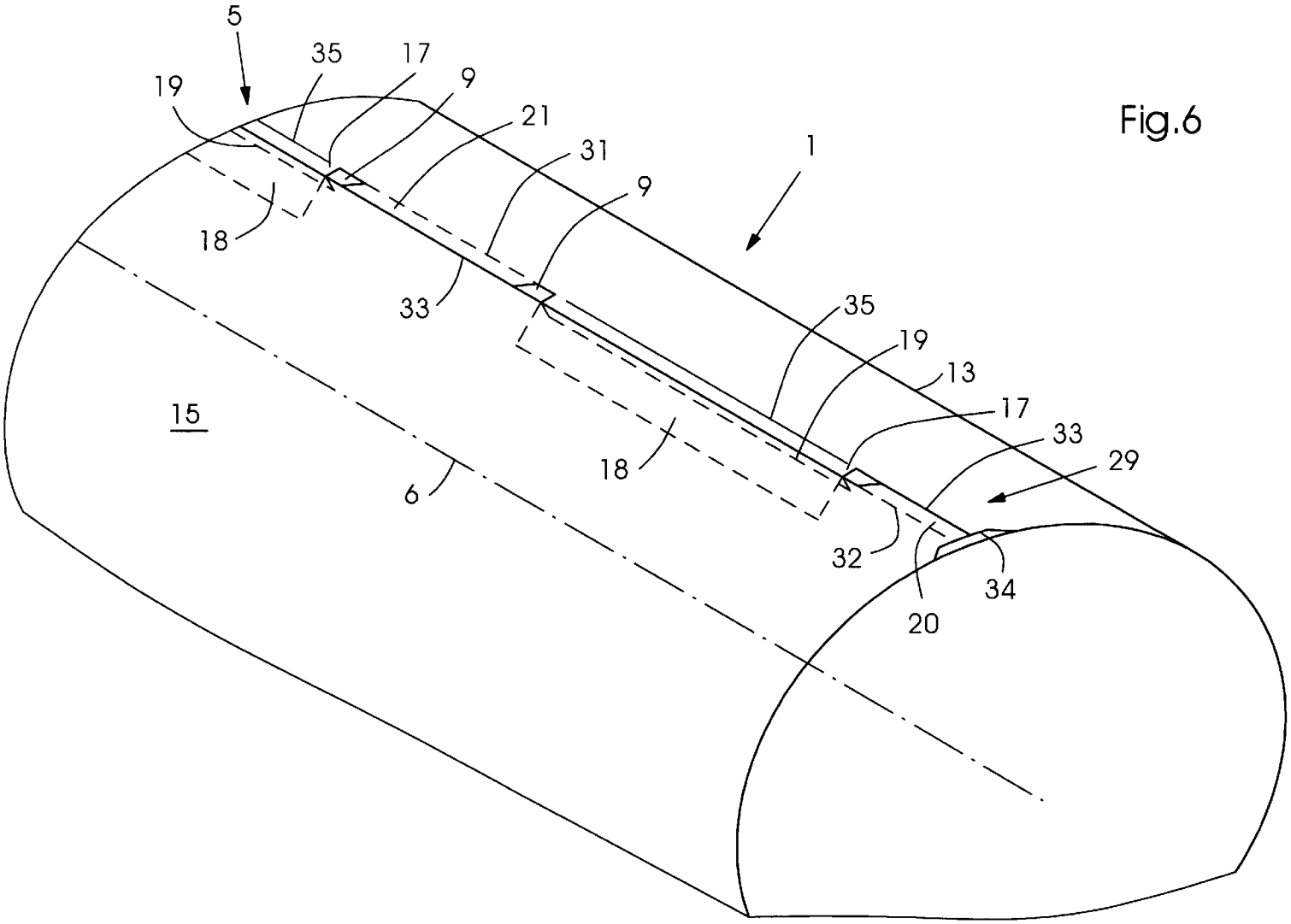
FIG. 6 is an enlarged fragmentary view of FIG. 5, showing the righthand end of the printing plate cylinder with a printing plate fastened thereon.

FIG. 6 shows a detail, illustrated on an enlarged scale, from FIG. 5. The right end face of the printing unit cylinder, with a printing plate fastened on it, is reproduced.

In this Fig., which is illustrated on a somewhat enlarged scale, the tensioning region 5, starting from the right end face 4, extends to the cylinder center. A recess 34 can be seen in the edge region of the essentially closed surface 29 of the printing form 13; such a recess is likewise provided on the right end face 3 of the printing unit cylinder 1.

The fastening tabs 18, 19 of the printing form leading and printing form trailing edges 16, 17 are illustrated as engaging into the pockets 9 in a similar way to FIG. 5. The pockets 9 designed rectangularly or with rounded edges are delimited by webs 20 or 21 which form the supporting surface for the rubber blanket cylinder 36. In the example shown in FIG. 5 or 6, the rubber blanket cylinder 36 would be supported by the webs 21, 22 and 23 together with the edge webs 20 and 24 adjacent to the edge. In this case, the abutment point 33 of the edge web 24 and printing form trailing edge 17 lies on the generating line 31, whilst the abutment point 33 of the web 21 and an indentation on the printing form leading edge 16 is located on the generating line 32. In the region of the pockets 9, the fastening tabs 19 run directly behind the flexural edge 35 into the interior of the pocket 9. In the region of the pocket 9, there is no rolling contact in the nip between the rotating surfaces of the cylinders 1, 36, although this is compensated again by the webs 21 to 23 and the edge webs 20 and 24. The abutment points 33 form a spacing of the order of magnitude of between 0.1 and 0.2 mm in the essentially closed surface 29 of the printing form surface 15. Moreover, since said abutment points lie, offset relative to one another, on the circumferential surface 2 of the printing unit cylinder 1, the disturbance can be reduced considerably.

We claim:

1. A rotary printing press with a printing unit cylinder and a printing form fastenable on said printing unit cylinder, comprising:

a printing form having bent ends, said bent ends having fastening tabs which extend into a interior of a tensioning gap portion, said printing form having a printing form leading edge and a printing form trailing edge;

a printing unit cylinder having a circumferential surface with a plurality of pockets; said plurality of pockets engage said fastening tabs of said printing form;

webs provided between said fastening tabs and disposed alternatively and opposite to one another on said printing form leading edge and printing form trailing edge, said webs on said printing form leading edge and said webs on said printing form trailing edge terminating on different generating lines of said printing unit cylinder when said printing form is mounted over said printing unit cylinder.

2. The rotary printing press according to claim 1, wherein said printing unit cylinder having said printing form mounted thereon is in cooperative engagement with a further printing unit cylinder having a continuous rubber blanket sleeve mounted on the circumference thereof.

3. The rotary printing press according to claim 1, wherein said webs have abutment locations arranged alternately over the breadth of said printing unit cylinder.

4. The rotary printing press according to claim 3, wherein said different generating lines comprise a first generating line and a second generating line, and wherein said abutment locations of said webs lie alternately on said first generating line and said second generating line of said printing unit cylinder.

5. The rotary printing press according to claim 3, wherein said abutment locations are formed above material bridges of said printing unit cylinder.

6. The rotary printing press according to claim 3, wherein said abutment locations are at a spaced distance of between 0.1 and 0.2 mm from one another.

7. The rotary printing press according to claim 6, wherein said distance is 0.1 mm.

8. The rotary printing press according to claim 1, wherein said pockets run at an inclination into an interior of said printing unit cylinder.

9. The rotary printing press according to claim 1, wherein said printing-form leading and printing-form trailing edges have indentations located between said webs.

10. The rotary printing press according to claim 5, wherein said printing form is locked-up on said circumferential surface of said printing form cylinder by lock-up elements at said trailing edge of said printing form, said webs and said indentations corresponding thereto being pushed within one another.

11. The rotary printing press according to claim 9, wherein said fastening tabs on said printing-form leading edge engage with a side of said pocket that is located opposite said lock-up elements.

* * * * *